US005884821A

United States Patent [19]

Wilhelmstaetter et al.

[11] Patent Number: 5,884,821

[45] Date of Patent: Mar. 23, 1999

[54] DEVICE FOR DISPENSING DETERGENT, PARTICULARLY FOR DISHWASHERS

[75] Inventors: Johann Wilhelmstaetter, Giengen/Huerben; Helmut Jerg, Giengen; Bernd Schessl, Dillingen; Gerhard Fetzer, Gundelfingen; Michael Hartmann, Hoechstaedt; Markus Hoepfl, Lauingen/Donau; Karl-Heinz Rehm, Dischingen; Rudolf Schmidt, Giengen, all of Germany; Daniele Cerruti, Caresana-VC; Giovanni Perucca, Motta De Conti (VC), both of Italy

[73] Assignees: BSH Bosch und Siemens Hausgeräte GmbH, München, Germany; ELTEK S.p.A., Casale Monferrato, Italy

[21] Appl. No.: 779,945

[22] Filed: Dec. 23, 1996

[30] Foreign Application Priority Data

Dec. 21, 1995 [DE] Germany ..... 195 48 105.4

[51] Int. Cl.[6] ..... B67D 3/00

[52] U.S. Cl. ..... 222/511; 222/561; 222/651; 134/93

[58] Field of Search ..... 222/511, 517, 222/561, 651, 652; 134/93

[56] References Cited

U.S. PATENT DOCUMENTS

| | | | |
|---|---|---|---|
| 3,012,565 | 12/1961 | Lines | 134/93 |
| 3,419,190 | 12/1968 | Kauffman et al. | 222/652 |
| 4,589,579 | 5/1986 | Morita | 222/561 |
| 4,984,596 | 1/1991 | Westfelt | 222/651 |
| 5,529,219 | 6/1996 | Ward | 222/561 |

FOREIGN PATENT DOCUMENTS

| | | | |
|---|---|---|---|
| 746231 | 11/1966 | Canada | 222/651 |

*Primary Examiner*—Joseph A. Kaufman
*Attorney, Agent, or Firm*—Herbert L. Lerner; Laurence A. Greenberg

[57] ABSTRACT

A liquid-carrying container of machine, such as a dishwasher, has a detergent metering device disposed in a boundary wall thereof. The device has a housing with at least one container in which the detergent may be placed and which may be closed with a cover. The cover may be opened and closed with a control unit. The cover moves linearly, quietly, and with a minimal space requirement in a plane which extends parallel to the boundary wall of the machine.

25 Claims, 5 Drawing Sheets

DEVICE FOR DISPENSING DETERGENT, PARTICULARLY FOR DISHWASHERS

BACKGROUND OF THE INVENTION

FIELD OF THE INVENTION

The invention relates to a detergent dispenser, particularly for dishwashers, in which the device located in a boundary wall of a liquid-carrying container is comprised of a housing with at least one container to receive detergents, each of which is closed by a cover which can be controllably opened.

In dishwashers, household dishwashers in particular, dispensers are customarily used by means of which various dispensed agents such as dishwasher detergents and rinse agents can be added by doses at a predetermined point in time of a current wash cycle to wash water circulated in the dishwasher, controlled by a programmed control unit.

Such dispensers have become known heretofore, from European patent disclosure EP 0 602 572 or German Offenlegungsschrift DE 38 02 210, for instance. As customary, they have at least one container located in a door for closing a wash compartment of the dishwasher and directed toward the wash compartment. The container has at least one space for at least one single dose of detergent. The container for detergents is closed by a cover which, as described above, is controllably opened.

In addition to the container described above, which is customarily used for a powdered detergent, the above-cited prior art documents have an additional container for liquid rinse agent.

When opened, the cover in accordance with the above-mentioned prior art documents is moved in an upward direction about a horizontal axis as a result of the initial tension of a spring. This swinging open of the cover has the disadvantage that the rim of the cover opposite the horizontal axis completes a semi-circular motion directed into the interior of the wash compartment of the dishwasher, which should take place with as little obstruction as possible. Such dishwashers customarily have dish racks to accommodate the dishes to be washed and one of the dish racks is located in the area of the dispenser. This dish rack must therefore be designed so that the cover of the detergent dispenser is not hindered from swinging open, since if the cover is hindered in opening by projecting dishes or by parts of the dish rack, the resulting incomplete opening of the detergent container prevents complete dispensing and subsequent flushing of the container. This results in reduced detergent concentration in the circulated wash water, which leads to an inadequate cleaning result. However, a corresponding design of the dish rack, such as by a setback of the front edge or by a recess, leads to a constriction of the filling space of a dishwasher which is limited in any case.

A further disadvantage of the well-known swinging motion of the cover is that, due to the initial tension of the above-mentioned spring, the cover vigorously strikes the door to which the detergent dispenser is fastened, thus producing a noise. This may also result in damage to the dispenser.

SUMMARY OF THE INVENTION

It is accordingly an object of the invention to provide a device for dispensing detergent, particularly for dishwashers, which overcomes the above-mentioned disadvantages of the heretofore-known devices and methods of this general type and which integrates into a cover with space saving and noiseless movement.

With the foregoing and other objects in view there is provided, in accordance with the invention, a combination of a liquid-carrying container having a boundary wall, such as a dishwasher with a front-loading door, and a device for dispensing detergent disposed in the boundary wall of the container. The device comprises:

a housing defining a container for receiving detergent, and a cover movably disposed between a closed position in which the container is closed, and an open position in which the container is open;

the cover being formed so as to move between the closed position and the open position substantially linearly and substantially parallel to the boundary wall.

In other words, the object of the invention is solved in that the cover completes a substantially linear movement in a plane parallel to the boundary wall when it is opened or closed.

The linear movement of the cover in a plane parallel to that of the wall to which the dispenser is attached makes it necessary to provide for an open area for the dispenser only at the level of the housing and the cover. This results in a substantial savings of space that can be used for loading the dish rack. Since, as a result of its linear movement, the cover does not come into contact with any additional part of the dishwasher, the production of noise, such as that caused by the striking of the cover, is effectively avoided. The disadvantages of the above-cited prior art are thus avoided in a simple manner with the detergent dispenser in accordance with the invention.

According to an added feature of the invention, the cover remains essentially within the plane of the housing in its closed and open positions and during the linear movement from one to the other position. This measure brings about a further savings in the space requirement for the movement of the cover of the detergent dispenser in accordance with the invention.

According to an additional feature of the invention, the housing has guides for the linear movement of the cover. This brings about a simple design and thus makes production of the dispenser in accordance with the invention simple and cost-effective.

Advantageously, the guides for the cover are slideways or guide tracks, bringing about a further simplification of the dispenser structure.

According to again another feature of the invention, the slideways are located at opposite sidewalls of the housing, which results in an additional savings of space by the device in accordance with the invention compared to guides in the face wall, for instance.

The slideways are expediently executed as channels placed in the sidewalls of the housing, which brings about yet an additional simplification of the device.

In a particularly advantageous manner, the cover surrounds the sidewalls of the housing on which the slideways are located with lateral extensions, in which the lateral extensions have sliders projecting into the slideways. In addition to simple and cost-effective manufacture, this simple construction of the device in accordance with the invention also results in further protection against contamination by deposits since the slideways are essentially covered by the lateral extensions of the cover.

According to yet another feature of the invention, the linear movement of the cover takes place with the support of or against the force of an elastic element. Reliable function of the device in accordance with the invention is assured by the support of the movement of the cover by means of an elastic element which is tensioned when the cover is closed.

In an expedient manner, the elastic element is extended essentially parallel to the sliding direction of the cover which optimizes the effect of the elastic element on the movement of the cover.

The elastic element is preferably arranged in such a manner that it cushions the impact caused by the opening movement of the cover, which brings about an additional avoidance of noise.

According to yet an added feature of the invention, the elastic element is a torsion spring acting between the cover and the housing, resulting in additional simplification of the device in accordance with the invention. Alternatively, the elastic element is a leaf spring acting between the cover and the housing. In light of its intended use, the cover contains a continuous seal on its surface facing the container which, when the device is in its closed position, is in contact with the essentially continuous rim of the container projecting toward the cover. By a simple manner and means, this measure makes it possible to seal the container in the areas in which a sealing effect is desired, particularly as protection against detergent from falling or flowing out.

In a particularly advantageous manner, the seal is sufficiently elastic that it raises the cover from the rim of the container when going from the closed position. This creates a support for the opening movement of the cover of the device in accordance with the invention by a simple manner and means, further improving the reliability and functionality of the device.

According to again a further advantageous feature of the invention, the cover is guided in the slideways in such a manner that the seal does not contact the rim of the container when the cover is moved in a linear direction. This effectively avoids damage to the seal and friction arising as a result of contact between the seal and the rim of the container, which could impair the function of the device in accordance with the invention.

This is achieved in a particularly advantageous manner in that the slideways have gradations which are located at a different level in relation to the predominant path of the slideways. Thus, contact of the seal with the rim of the container during the linear movement of the cover can be avoided by a simple manner and means.

In an expedient manner, the gradations are located at a essentially lower level compared to the predominant path of the slideways in relation to the rim of the container. This measure makes it certain that the seal of the cover does not come into contact with the rim of the container during the primary movement of the cover in the predominant path of the slideways and that the slideway gradations take over the guidance of the cover in at least one end position of the movement of the cover. This makes a further simplification of the design and manufacture of the device in accordance with the invention possible.

In a particularly advantageous embodiment, two gradations arranged at a distance from one another are formed in each slideway in which the first gradation is located at the extreme end of the particular slideway. The spacing between the gradations assures reliable guidance of the cover in the gradations and by a simple manner and means makes certain that the cover is reliably guided in the gradations when it is moved into the closed position and is in the closed position as well, since the extreme end of the slideway determines the closed position of the cover.

In accordance with yet a further feature of the invention, each of the lateral extensions of the cover has a front and rear slider with a distance between them essentially corresponding to the distance between the two gradations of one of the slideways. This measure makes a simple design of the device in accordance with the invention possible in which it is made certain that the cover is also reliably guided and held in the gradations.

Advantageously, an elevation of the slideway in relation to the rim of the container is located in the direction of the opening of the cover after the second gradation and adjacent to the second gradation of the container. During the closing movement of the cover, this elevation of the slideway leads to the front area of the cover with the seal first contacting the rim of the container, and then after passing the above-cited elevation, the cover comes to rest at essentially the same time over the total circumference of the seal in a practically uniform lowering movement. This brings about a reliable contact of the seal without greater closing movements of the seal, resulting in a substantial prolongation of the service life of the seal.

Referring once more to the above-noted state of the art, there are provided locking mechanisms in which the latching of a locking bolt takes place and which are located adjacent to the container and left open. For that reason, the earlier known detergent dispensers have the disadvantage that these locking mechanisms are damaged during the loading or removal of table ware, for instance, and that detergent or pieces of dirt get into the locking mechanisms when detergents are loaded or dirty tableware to be washed is arranged. This can lead to impairment or even prevention of the function of the locking mechanisms, i.e., the cover can only be closed with effort or no longer closed at all, whereby its closing or attempt to close it against the resistance of the accumulated pieces of dirt or detergent can lead to damage to the latch.

It is therefore an additional object of the invention to provide, in a simple manner and by simple means, a detergent dispenser in which the locking mechanisms are not subject to impairment from accumulations of dirt or detergent.

The additional object of the invention is achieved in that the device is equipped with a latching and unlatching system acting between the cover and housing and whose locking mechanisms are covered by it in whatever position the cover is found.

Accordingly, the cover moved in a linear direction acts as a covering of the locking mechanism so that it is impossible for deposits of dirt and detergent to accumulate in the area of the locking mechanism thereby effectively preventing an impairment of the function of the locking mechanism.

According to an advantageous embodiment of the invention, at least one of the lateral extensions of the cover is provided with openings for the entrance of liquid. When the cover is in its closed position, the liquid entering through the openings can begin to dissolve the detergent filled into the container, and when the cover is in its open position, it cleans the latching and unlatching system of any deposits present in it, thereby ensuring reliable function of the device in accordance with the invention.

Advantageously, the cover has a wiper or scraper blade running crosswise to the direction of sliding and protruding in the direction of the container, said wiper being in contact with the rim of the container at least during the closing movement of the cover. The wiper pushes a sufficient amount of the detergent filled into the container out of the device in accordance with the invention so that it is impossible for deposits to accumulate in the latching and unlatching system and reliable function of the device in accordance with the invention is assured.

Other features which are considered as characteristic for the invention are set forth in the appended claims.

Although the invention is illustrated and described herein as embodied in a device for dispensing detergent, particularly for a dishwasher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
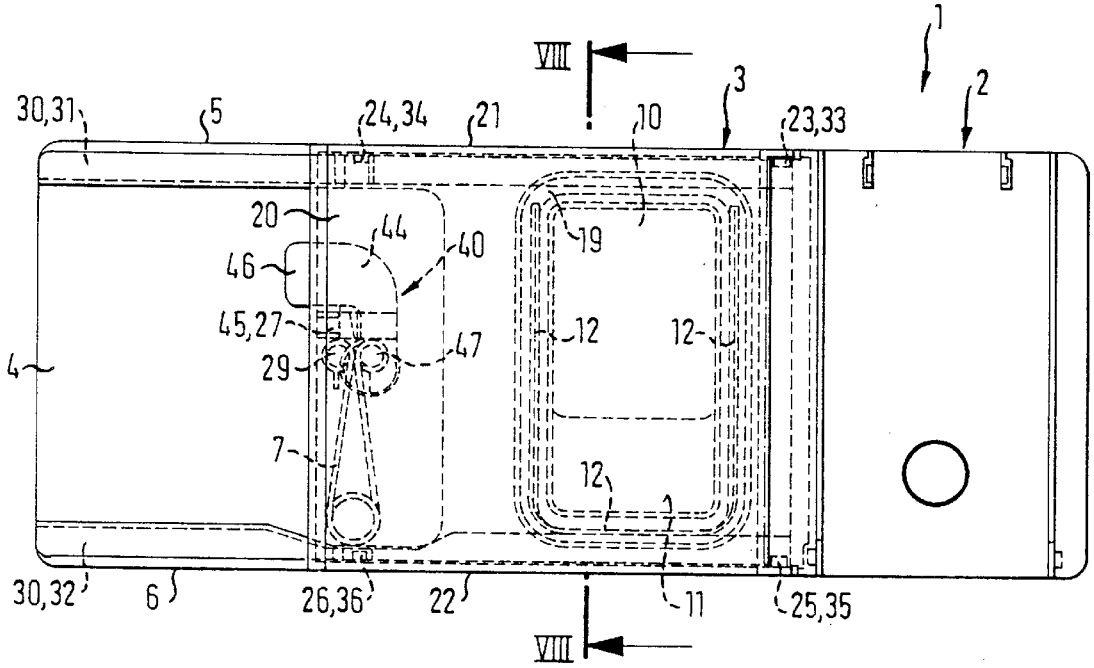
FIG. 1 is a front view of the device in accordance with the invention in a closed position.

Referring now to the figures of the drawing in detail and first, particularly, to FIG. 1 thereof, there is seen a detergent dispenser 1 which is installed in a non-illustrated door of a household dishwasher. The door is a conventional door which pivots about a horizontal axis, towards a wash compartment of the dishwasher which is closed by the door. The part of the door projecting into the wash compartment and which closes the wash compartment, a so-called inner door, is thus a boundary wall of the wash compartment.

In the exemplified embodiment shown, the device 1 has a dispenser 2 for liquid rinse agent which is embodied as described in the above-noted publication EP 0 602 572.

A dispenser 3 for detergent used for liquid or powdered detergent is located adjacent to the dispenser 2 for liquid rinse agent. This dispenser 3 for detergent is comprised of a container 10 in a housing 4 of the device in accordance with the invention 1 to receive a detergent to be added to the wash water circulated in the domestic dishwasher. In the filled state the container 10 is closed by a cover 20 which is opened at a predetermined time by a programmed controller, which is not shown, in the course of a wash cycle selected by the user of the domestic dishwasher. In accordance with the invention, the cover 20 completes essentially linear movements in a plane parallel to the door when opened or closed, i.e., along housing 4 of device 1.

Figure 8:
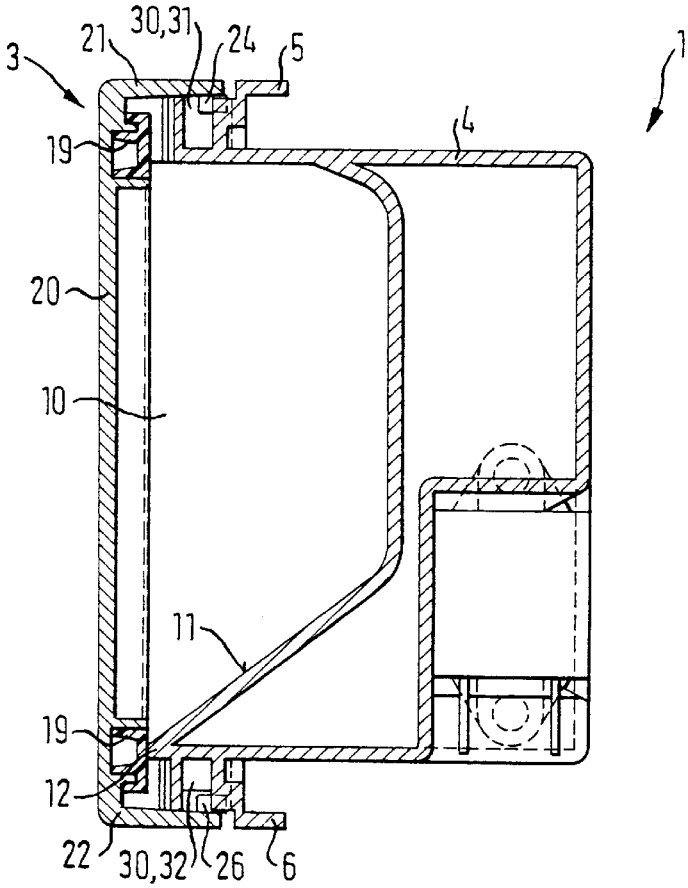
FIG. 8 is a sectional view through the device taken along the line VIII—VIII in FIG. 1 and viewed in the direction of the arrows.

As is particularly evident from FIG. 8, the container 10 has an inclined discharge surface 11 which extends in the lower portion of container 10 when device 1 is in use and aids the filled detergent in spilling out or flowing out as a result of gravity.

In order to guide the linear movement of the cover 20 in accordance with the invention, the housing 4 has guides 30 on it its opposing sidewalls 5, 6, said guides being designed as slideways 31, 32. These slideways 31, 32 are formed as channels in the sidewalls 5, 6 of housing 4. The cover 20 encloses the sidewalls 5, 6 of housing 4, on which the slideways 31, 32 are located, with lateral extensions 21, 22. The lateral extensions 21, 22 have sliders 23, 24, 25, 26 which project into slideways 31, 32.

Figure 10:
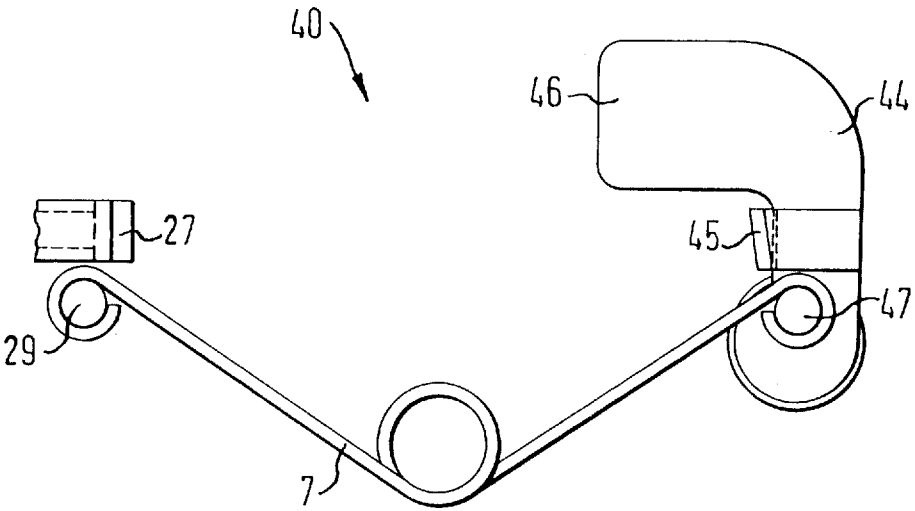
FIG. 10 is a similar view of the latching and unlatching system in the open position.

The linear movement of cover 20 is supported by an elastic element 7 which is executed as a torsion spring 7 acting between cover 20 and the housing 4 in the exemplified embodiment. In the closed state of device 1, the torsion spring 7 is under tension. During the opening movement of cover 20, torsion spring 7 extends parallel to the sliding direction of cover 20. The position of torsion spring 7 in the closed position of device 1 is indicated by dashed lines in FIG. 2 and in detail in FIG. 10.

Figure 4:
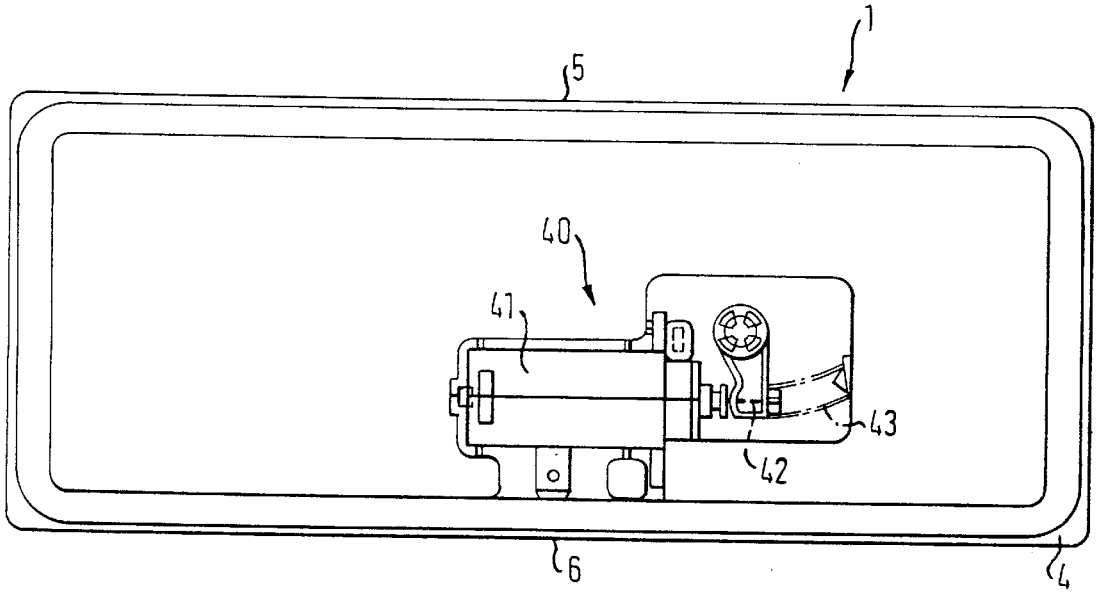
FIG. 4 is a rear view thereof.

The detergent dispenser 1 in accordance with the invention is further equipped, which is known per se, with a latching and unlatching system 40 which acts between cover 20 and housing 4. The latching and unlatching system 40 can be embodied as any state of the art system (see, for instance, EP 0 602 572 or DE 38 02 210). In the exemplary embodiment shown, the latching and unlatching system 40 is comprised of an actuator 41 (see FIG. 4) located on the back of the housing 4, which turns a rotating lever 42 against the force of a spring 43 acting between the rotating lever 42 and housing 4 about a predetermined angle to bring about the open position of device 1. The rotating lever 42 is fixedly joined to a lever 44 located on the front of housing 4 via an axis, which is not visible, supported in housing 4, so that the movement of the rotating lever 42 causes a movement of lever 44. Lever 44 has a projecting catch 45 which, in the closed position (FIG. 9) interacts with a catch 27 of cover 20 by latching. Furthermore, the lever 44 has a handle 46 which is formed as an extension of lever 44 and projects past the left rear rim of cover 20 in its closed position corresponding to FIG. 1. The torsion spring 7 is held on a pin 47 of lever 44 by means of a formed loop and at the other end to a pin 29 of cover 20 by means of another loop.

Figure 2:
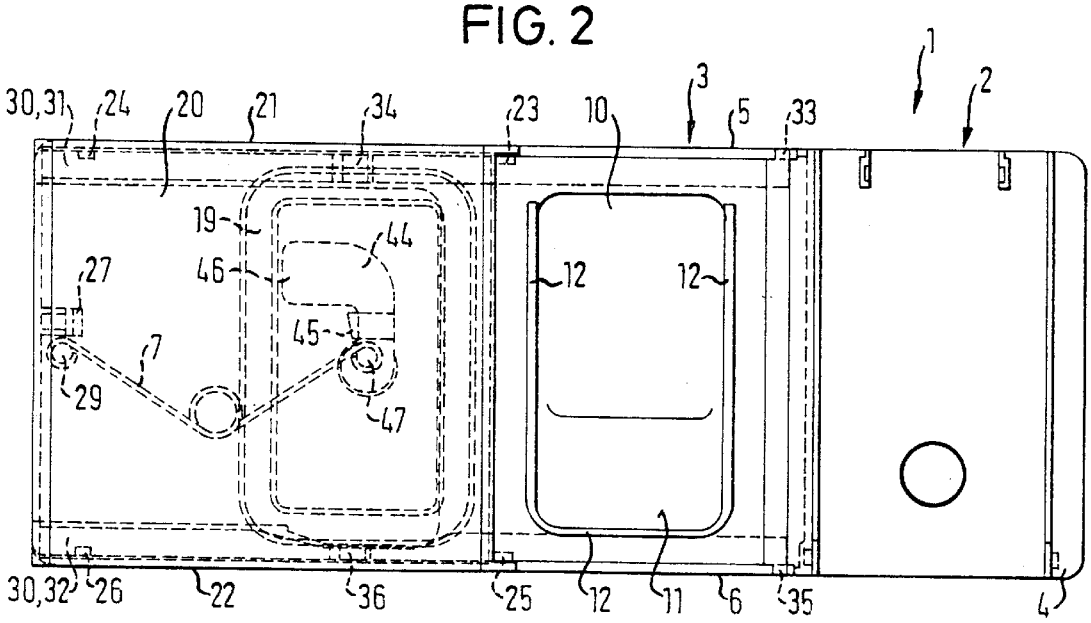
FIG. 2 is a front view of the device in an open position.
Figure 3:
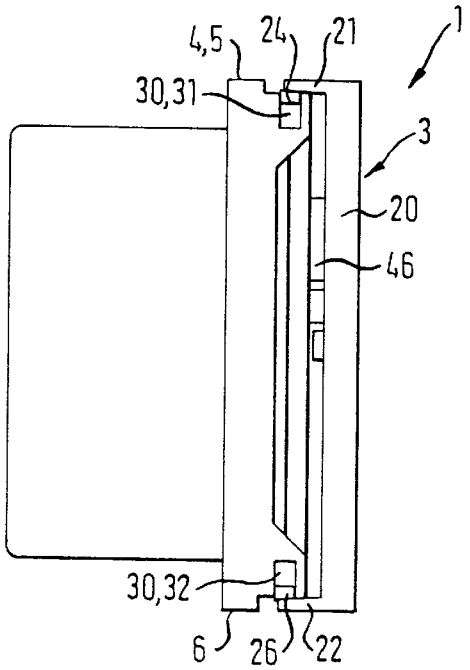
FIG. 3 is a side view thereof.

A continuous seal 19 is located on the inside of cover 20 facing container 10, said seal being in contact with a rim 12 of the container 10 which projects toward the cover 20 in the closed position of device 1. In the exemplified embodiment, the rim 12 encompasses the vertical lateral edge and lower edges of container 10 as seen in FIG. 2 so that the upper edge of container 10 remains open.

Figure 7:
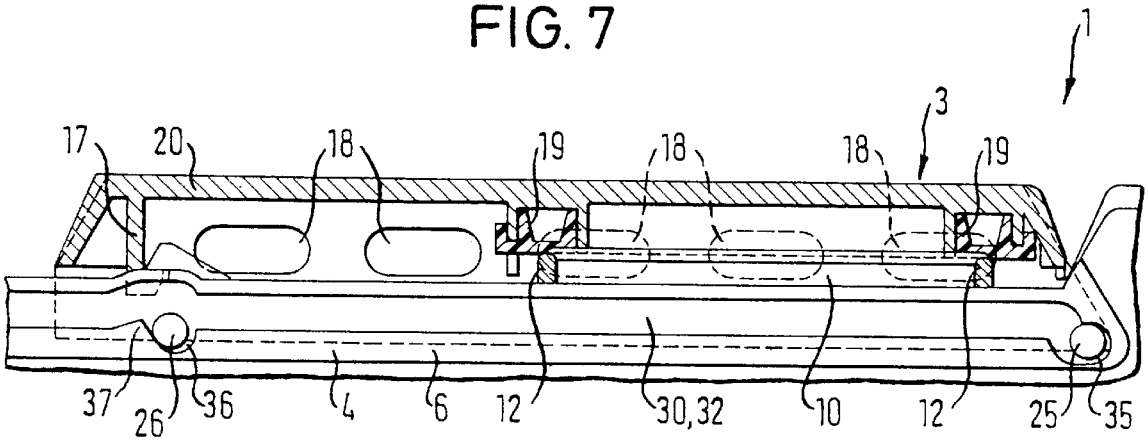
FIG. 7 is an enlarged detail of the sectional view of FIG. 6.

As can be seen best in FIG. 7, the slideways 31, 32 have gradations 33, 34, 35, 36 which are located at a lower level than the predominant path of the slideways in relation to the rim 12 of container 10. Two gradations are proved in each slideway 31, 21, in which a first gradation 33, 35 is located at the extreme end of the particular slideway 31, 32, i.e., adjacent to the dispenser 2 for liquid rinse agent. Each of the additional second gradations 34, 36 is located at a distance. Each of gradations 33, 34, 35, 36 has a lift gradient. In the direction of opening of the cover after the second gradation 34, 36, an elevation 37 in relation to rim 12 of the container 10 is provided which is designed as a continuation of the above-mentioned lift gradient of the recess 34, 36 and its function will be described further below in the description of the function of device 1 in accordance with the invention.

At each of its lateral extensions 21, 22, the cover 20 has a front slider 23, 25 and a rear slider 24, 26 which are located at a distance from each other essentially corresponding to the distance between the two gradations 33, 34 and 35, 36 of one of the slideways 31, 32.

In the exemplified embodiment shown, both lateral extensions 21, 22 of cover 20 are provided with openings 18 (FIGS. 5, 6 and 7) for the for the entrance of liquid which begins to dissolve the detergent contained in container 10 when cover 20 is in its closed position and cleans the latching and unlatching system 40 and the elastic element 7 when cover 20 is in its open position.

A wiper 17 fixed to cover 20 projecting in the direction of container 10 and running crosswise to the direction of slide of cover 20 can be best seen in FIG. 7. At least during the closing movement of cover 20, the wiper 17 contacts the rim 12 of container 10.

The function of the device 1 in accordance with the invention will be described in detail below corresponding to the embodiment shown. In order to introduce the detergent, the user opens the door of the domestic dishwasher so that device 1 is essentially in a horizontal position. As described further below, device 1 is in its open position after completing a previous wash cycle, i.e., container 10 can be filled without difficulty. Should device 1 be in its closed position, such as in the case of a new domestic dishwasher, it is possible to open the cover 20 by a slight sideways pressure on handle 46 of lever 44, as a result of which lever 44 is turned and catch 45 releases catch 27 of cover 20.

Figure 9:
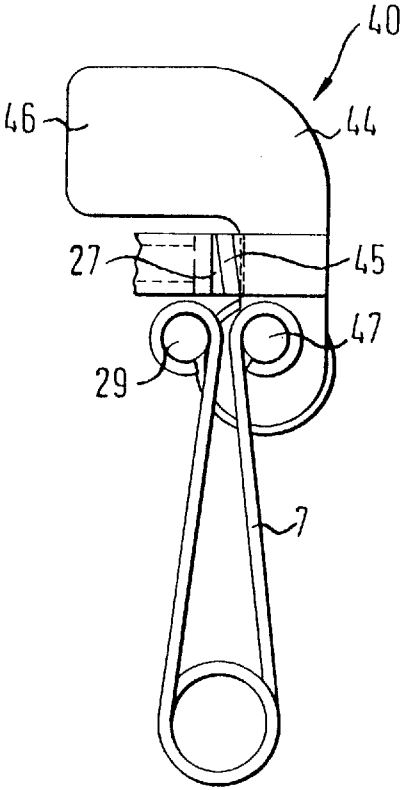
FIG. 9 is a partial view showing a detail of the latching and unlatching system of the device in the closed position.

The user of the domestic dishwasher fill an appropriate amount of the desired detergent into container 10 and closes cover 20 by manually pushing cover 20 against the force of torsion spring 7 from its open position into its closed position, whereby tension is placed on torsion spring 7 (FIG. 9).

In the open position and during the movement from the open position into the closed position of device 1, the sliders 23, 24, 25, 26 are located in slideways 31, 32 at a higher level in relation to the rim 12 of the container 10 than in the closed position. When cover 20 is pushed in a linear direction, seal 19 thus does not come into contact with rim 12 of cover 20. Almost at the end of the closing movement of cover 20, i.e., when the front slider 23, 25 is located just in front of gradation 33, 35, each rear slider 24, 26 is located on elevation 37. Thus cover 20 assumes a slightly inclined position. The makes it easier for the user to close cover 20 because seal 19 comes into contact with rim 12 of container 10 only gradually. As the user continues the linear movement of cover 20, the front slider 23, 25 slides into gradation 33, 35 via the lift gradient and causes the front part of seal 19 to come into contact with rim 12 while the rear part of cover 20 still remains raised above rim 12 of container 10.

During the linear movement of cover 20 from its open position into its closed position, the wiper 17 slides over rim 12 of container 10 and thus pushes any excess detergent out of device 1 in accordance with the invention so that no deposits are possible in the latching and unlatching system 40.

After passing elevation 37, the rear slider 24, 26 now reaches the corresponding recess 34, 36, with the result that seal 19 gradually comes into complete contact with rim 12 of container 10. The lowering movement essentially prevents seal 19 from being pushed past rim 12 of container 10, since after slider 24, 26 has passed the corresponding elevation 37, the movement of cover 20 is essentially vertical and thus seal 19 is brought into contact with rim 12 by means of pressure and not by means of a pushing movement.

Concurrent with the movement of cover 10 by sliders 24, 26 after passing elevation 37, catch 27 is latched with catch 45 of lever 44. As a result, the cover is latched and secured.

As can be seen in FIG. 7, the front gradations 33, 35 have a short and straight section running parallel to slideways 31, 32. In the final closed position of cover 10, the slider 23, 25 guided in the front recesses 33, 35 also holds seal 19 on rim 12 of container 10 with initial tension and thus supports the latching function of the two catches 27, 45.

After completing the action of filling the detergent into device 1 and after closing cover 20, the user closes the door of the domestic dishwasher and starts it with a selected wash cycle.

As the "Pre-Rinse" or "Wash" subprogram of the cycle now starts, circulating wash water circulated by means of a circulating pump is sprayed onto the loaded dishes to be washed by means of spray devices, in which the inner door projecting into the wash compartment is also contacted by the wash water. Therefore, liquid also penetrates through openings 18 in the lateral extensions 21, 22 of cover 20 into container 10 and thus begins to dissolve the detergent filled into container 10.

Figure 5:
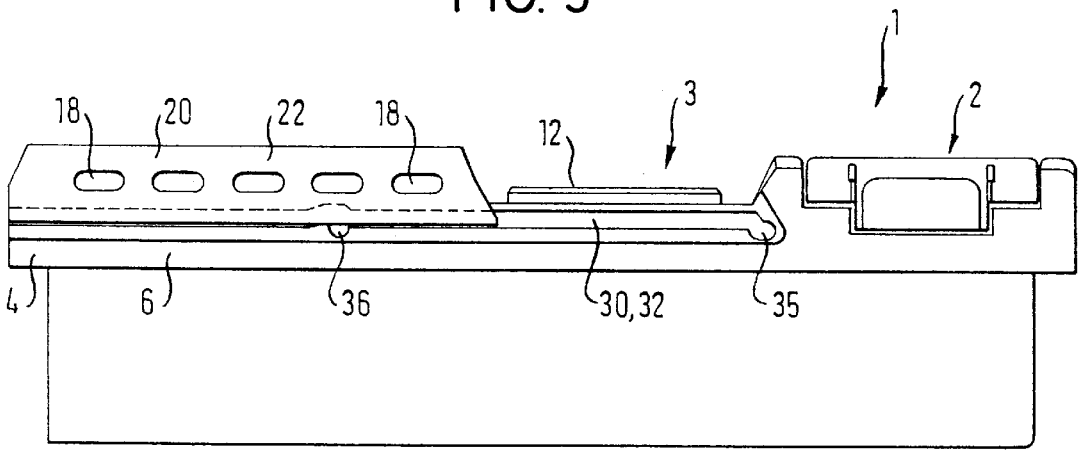
FIG. 5 is a bottom view of the device in the open position.
Figure 6:
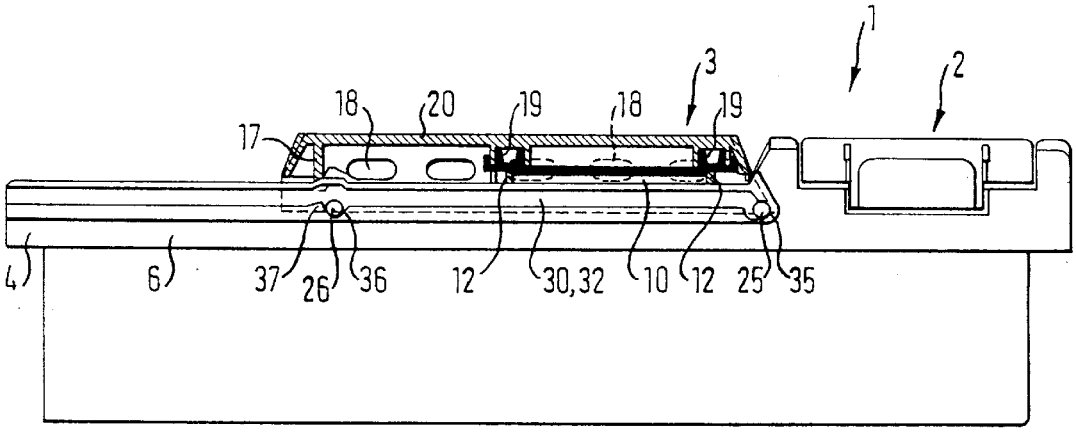
FIG. 6 is a partly sectional bottom view of the device in the closed position.

At a prescribed time during the "Wash" subprogram, the programmed controller activates actuator 41 which turns the rotating lever 42 and the lever 44 connected with it against the force of spring 43. The angular movement of lever 44 causes latch 45 to be moved away from latch 27 and releases latch 27. The force of the tensioned torsion spring now pushes cover 20 in the slideways 31, 32 into the open position of device 1. The opening movement of cover 20 is supported by the fact that seal 19 is sufficiently elastic to raise cover 20 from the rim 12 of container 10 when moving from the closed position. Practice has shown that, due to the restoring force of seal 19, it would be possible to overcome the lift gradients of gradations 33, 34, 35, 36 even without the force of torsion spring 7. The force exerted by torsion spring 7 is in any case sufficient to make it possible to overcome the lift inclines of gradations 33, 34, 35, 36 and elevation 37 and to move cover 20 into its open position in slideways 31, 32 by means of sliders 23, 24, 25, 26. At the same time, torsion spring 7 extends essentially parallel to the sliding direction of cover 20. Due to this process, the device 1 in accordance with the invention changes from its closed position (FIGS. 1, 6 and 7) into its open position (FIGS. 2 and 5). The streams of wash water from the spray devices discussed above flush the quantity of detergent already partially dissolved from container 10 of device 1. However, the wash water sprayed by the spray devices also penetrates through the openings 18 of cover 20 into the space between cover 20 and housing 4 of the device 1 in accordance with the invention and is able to clean the parts of the latching and unlatching system 40 as well as torsion spring 7 located in this space. The wash water that has penetrated can flow out again through openings 18 which lower openings when in use.

The opening movement of cover 20 is cushioned by torsion spring 7. The cushioning of cover 20 and the avoidance of an impact on the interior side of the door or housing 4 of the device 1 eliminates noise in the operation of the device 1 in accordance with the invention. In the closed and open position as well as during the linear movement from one to the other position, cover 20 remains essentially within the plane of housing 4, which once more demonstrates the low space requirement of the device 1 in accordance with the invention.

The wash cycle selected by the use is continued to completion, while liquid rinse agent is possibly added from device 2 by the known manner and means during the "Rinse" subprogram. Both when cover 20 is closed (FIG. 1) as well as when it is open (FIG. 2), the locking mechanisms of the latching and unlatching system 40 and torsion spring 7 are constantly covered by cover 20 and are thus protected against deposits of detergent or particles of dirt as well as against mechanical shock.

The term "detergent" is generically used herein for any type of cleanser or other additive to be dispensed into a cavity, such as a wash liquid container of a dishwasher.

We claim:

1. In combination with a liquid-carrying container having a boundary wall, a device for dispensing detergent disposed in the boundary wall of the container, the device comprising:

a housing defining a container for receiving detergent, and a cover movably disposed between a closed position in which said container is closed, and an open position in which said container is open;

said cover being formed so as to move between the closed position and the open position substantially linearly and substantially parallel to the boundary wall.

2. The dispenser according to claim 1, wherein said housing defines a given plane, and said cover remains essentially within the plane of said housing in the closed and open positions and during a linear movement between the closed and open positions.

3. The dispenser according to claim 1, wherein said housing includes guides on which said cover is linearly guided.

4. The dispenser according to claim 3, wherein said guides for said cover are slideways.

5. The dispenser according to claim 4, wherein said housing has mutually opposite sidewalls and said slideways are disposed at said opposite sidewalls.

6. The dispenser according to claim 5, wherein said slideways are defined by channels formed in said sidewalls of said housing.

7. The dispenser according to claim 4, wherein said cover has lateral extensions formed thereon which surround said housing at said sidewalls, said lateral extensions carrying sliders which project into said slideways.

8. The dispenser according to claim 1, including an elastic element braced against said cover for supporting a linear movement of said cover between the closed and open positions.

9. The dispenser according to claim 8, wherein said elastic element extends substantially parallel to a sliding direction of said cover.

10. The dispenser according to claim 4, wherein said elastic element is disposed so as to cushion an opening movement of said cover.

11. The dispenser according to claim 8, wherein said elastic element is a torsion spring acting between said cover and said housing.

12. The dispenser according to claim 8, wherein said elastic element is a leaf spring acting between said cover and said housing.

13. The dispenser according to claim 1, wherein said container is formed with an essentially continuous rim projecting toward said cover, and including a continuous seal disposed on a surface of said cover facing said container, said seal contacting said rim in the closed position thereof.

14. The dispenser according to claim 13, wherein said housing includes guides on which said cover is linearly guided in such a way that said seal does not contact said rim during a linear movement thereof.

15. The dispenser according to claim 1, which further comprises a latching and unlatching system acting between said cover and said housing, said latching and unlatching system having locking mechanisms which are covered by said cover in any position thereof.

16. In combination with a liquid-carrying container having a boundary wall, a device for dispensing detergent disposed in the boundary wall of the container, the device comprising:

a housing defining a container for receiving detergent;

a cover disposed to move substantially linearly and substantially parallel to the boundary wall between a closed position in which said container is closed, and an open position in which said container is open; and said housing including slideways on which said cover is linearly guided, said slideways extending along a main path with a given level, and said slideways having gradations formed thereon at a different level relative to a main path of said slideways.

17. The dispenser according to claim 16, wherein said container is formed with an essentially continuous rim projecting toward said cover, and wherein said gradations are disposed at an essentially lower level relative to the main path of said slideways in relation to said rim.

18. The dispenser according to claim 16, wherein each said slideway is formed with two mutually spaced apart gradations, and a first of said gradations being formed at an extreme end of a respective said slideway.

19. The dispenser according to claim 18, wherein said cover has lateral extensions formed thereon which surround said housing at said sidewalls, and wherein said cover includes a front and rear slider disposed on each of said lateral extensions, a distance between said front and rear sliders essentially corresponding to a distance between the two gradations of each said slideways.

20. The dispenser according to claim 19, wherein each said slideway is formed with an elevation relative to said rim of said container, said elevation being disposed adjacent to and following a second said gradation as seen in an opening direction of said cover.

21. In combination with a liquid-carrying container having a boundary wall, a device for dispensing detergent disposed in the boundary wall of the container, the device comprising:

a housing defining a container for receiving detergent;

a cover disposed to move substantially linearly and substantially parallel to the boundary wall between a closed position in which said container is closed, and an open position in which said container is open, said cover having a surface facing said container; and said container being formed with an essentially continuous rim projecting toward said cover, and including a continuous seal disposed on said surface of said cover facing said container, said seal contacting said rim in the closed position thereof, and said seal being sufficiently elastic to raise said cover from said rim of said container when said cover is moved out of the closed position.

22. In combination with a liquid-carrying container having a boundary wall, a device for dispensing detergent disposed in the boundary wall of the container, the device comprising:

a housing defining a container for receiving detergent, said housing including slideways and opposing sidewalls; and a cover movably disposed between a closed position in which said container is closed, and an open position in which said container is open, said cover having lateral extensions formed thereon which surround said housing at said sidewalls, said lateral extensions carrying sliders which project into said slideways so that said cover moves between the closed position and the open position substantially linearly and substantially parallel to the boundary wall, at least one of said lateral extensions having an opening formed therein for introducing liquid.

23. In combination with a liquid-carrying container having a boundary wall, a device for dispensing detergent disposed in the boundary wall of the container, the device comprising:

a housing defining a container for receiving detergent;

a cover disposed to move in a sliding direction substantially linearly and substantially parallel to the boundary wall between a closed position in which said container is closed, and an open position in which said container is open; and a wiper disposed on said cover extending transversely to said sliding direction of said cover and projecting towards said container.

24. The dispenser according to claim 23, wherein said container is formed with an essentially continuous rim projecting toward said cover, and wherein said wiper is in contact with said rim of said container at least during a closing movement of said cover.

25. A detergent dispenser in a dishwasher, the dishwasher having a boundary wall enclosing a washing chamber of the dishwasher, and the detergent dispenser is disposed in the boundary wall, the device comprising:

a housing defining a container for receiving detergent, and a cover movably disposed between a closed position in which said container is closed, and an open position in which said container is open;

said cover being formed so as to move between the closed position and the open position substantially linearly and substantially parallel to the boundary wall.

* * * * *